US011252493B2

(12) United States Patent
Soeta et al.

(10) Patent No.: US 11,252,493 B2
(45) Date of Patent: Feb. 15, 2022

(54) HEARING DEVICE AND EARPHONE

(71) Applicant: RION CO., LTD., Kokubunji (JP)

(72) Inventors: Akihiro Soeta, Kokubunji (JP); Shinichiro Yanaga, Kokubunji (JP); Misae Shiba, Kawasaki (JP); Mikio Shiba, Kawasaki (JP)

(73) Assignee: RION CO., LTD., Tokyo (JP)

( * ) Notice: Subject to any disclaimer, the term of this patent is extended or adjusted under 35 U.S.C. 154(b) by 0 days.

(21) Appl. No.: 17/060,565

(22) Filed: Oct. 1, 2020

(65) Prior Publication Data

US 2021/0112328 A1 Apr. 15, 2021

(30) Foreign Application Priority Data

Oct. 11, 2019 (JP) ..... JP2019-188218

(51) Int. Cl.
*H04R 25/00* (2006.01)
*H04R 1/10* (2006.01)

(52) U.S. Cl.
CPC ..... *H04R 1/1016* (2013.01); *H04R 1/105* (2013.01)

(58) Field of Classification Search
CPC .. H04R 25/658; H04R 25/65; H04R 2460/11; H04R 25/456; H04R 25/652; H04R 25/608; H04R 25/656; H04R 25/48
See application file for complete search history.

(56) References Cited

U.S. PATENT DOCUMENTS 2,545,731 A * 3/1951 French ..... H04R 25/604 181/135
6,549,635 B1 * 4/2003 Gebert ..... H04R 25/456 381/324
8,855,347 B2 * 10/2014 Aubert ..... H04R 25/652 381/328
2009/0196444 A1 * 8/2009 Solum ..... H01Q 1/241 381/315
2017/0188126 A1 * 6/2017 Hirano ..... H04R 1/105

FOREIGN PATENT DOCUMENTS

JP 2016063276 A 4/2016

* cited by examiner

*Primary Examiner* — Amir H Etesam
(74) *Attorney, Agent, or Firm* — Procopio, Cory, Hargreaves & Savitch LLP

(57) ABSTRACT

A hearing device includes: an earphone that is adapted to be worn in a concha auriculae or an external auditory canal of an ear; and a cord that is adapted to extend so as to pass through an upper portion of a root of the ear from a back side of an auricle of the ear when the earphone is worn, and that is connected to the earphone, the cord that is adapted to abut against a cymba conchae of the ear when the earphone is worn.

9 Claims, 10 Drawing Sheets

HEARING DEVICE AND EARPHONE

CROSS-REFERENCE TO RELATED APPLICATIONS

This application is based upon and claims the benefit of priority from prior Japanese patent application No. 2019-188218, filed on Oct. 11, 2019, the entire contents of which are incorporated herein by reference.

TECHNICAL FIELD

The present invention relates to a hearing device and an earphone.

BACKGROUND ART

An RIC (Receiver-In-Canal) type hearing aid in which a receiver (speaker) for generating an air conduction sound is integrated into an earphone worn in an auricle, and a cartilage conduction hearing aid in which a vibrating portion for generating vibration based on an electric signal is built in an earphone and the vibration is conducted to a cartilage of an ear are available as examples of a hearing device for compensating for the sense of hearing of a hearing-impaired person.

For example, Patent Literature 1 discloses a cartilage conduction hearing aid including a cartilage conduction speaker and a cartilage conduction speaker cover. The cartilage conduction speaker is provided with an electromechanical transducer which transduces an electric signal into vibration. The cartilage conduction speaker cover entirely covers the speaker. Such a speaker cover is formed so as to be suited for the shape of an auricle of a wearer's ear. Therefore, the speaker can be stably retained in the auricle by the speaker cover.

Patent Literature JP-A-2016-63276

When importance is attached to a point that such a hearing device can be retained stably in the auricle and/or an external auditory canal of the ear where the hearing device is worn, the cover tends to increase in size. Therefore, when the related-art hearing device is worn in the auricle and/or the external auditory canal, the earphone of the related-art hearing device often tends to stand out to become an issue in terms of appearance. In addition, with the increase of the size of the earphone, the wearer sometimes feels discomfort when wearing the earphone. In addition, there is also a case where the earphone is inserted into the external auditory canal and the receiver is retained on a wall of the external auditory canal. In this case, the wearer may feel discomfort such as an oppressive feeling or a burdensome feeling.

The present invention has been accomplished in consideration of such problems inherent in the background art. An object of the present invention is to provide an earphone which can be stably retained in an auricle of an ear and obtain comfortable wearing feeling or which can be stably retained in the auricle and improve appearance when being worn, and a hearing device.

SUMMARY

According to an aspect of the invention, there is provided a hearing device comprising: an earphone that is adapted to be worn in a concha auriculae or an external auditory canal of an ear; and a cord that is adapted to extend so as to pass through an upper portion of a root of the ear from a back side of an auricle of the ear when the earphone is worn, and that is connected to the earphone, the cord that is adapted to abut against a cymba conchae of the ear when the earphone is worn.

According to an another aspect of the invention, there is provided an earphone that is configured to conduct vibration based on an electric signal to a cartilage of an ear, the earphone which is adapted to abut against at least two of an antitragus, a tragus and an inlet of an external auditory canal of the ear when the earphone is worn, and by which an upper side of the external auditory canal is made open when the earphone is worn.

According to an another aspect of the invention, there is provided an earphone comprising: a body portion that is configured to conduct vibration based on an electric signal to a cartilage of an ear, and that is internally provided with an electromechanical transducer; and a cover that is put on the body portion, the cover that is adapted to abut against an inlet of an external auditory canal of the ear, and that includes a vent to open between the external auditory canal and an external environment, when the earphone is worn.

BRIEF DESCRIPTION OF DRAWINGS

FIG. 5A being a perspective view, FIG. 5B being a side view, FIG. 5C being a plan view, FIG. 5D being a bottom view, FIG. 5E being a back view, FIG. 5F being a front view.

DESCRIPTION OF EMBODIMENTS

A hearing device in which the present invention is embodied, and an earphone will be described below with reference to the drawings. Incidentally, directions described using "up", "down", "left", "right", "front", "rear", etc. in the description of the present invention etc. are the directions of a wearer who has already worn the hearing device or the like unless otherwise stated specially.

Figure 1A:
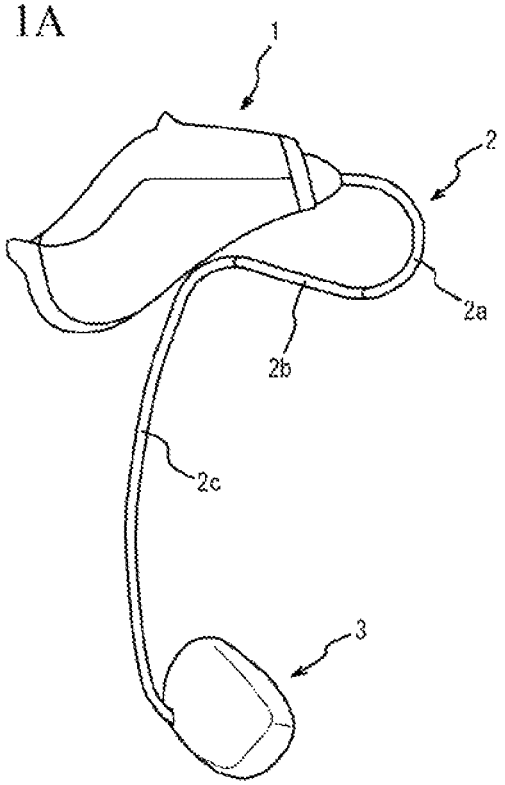
FIGS. 1A to 1C are views showing a first embodiment of a hearing device (cartilage conduction hearing aid) in which the present invention is embodied (for right ear use), FIG. 1A being a side view, FIG. 1B being a front view, FIG. 1C being a bottom view.
Figure 1B:
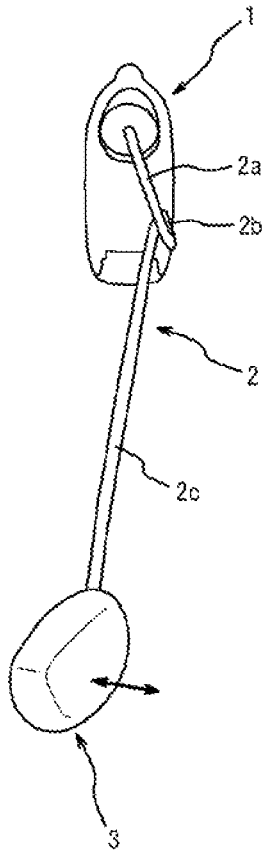
Figure 1C:
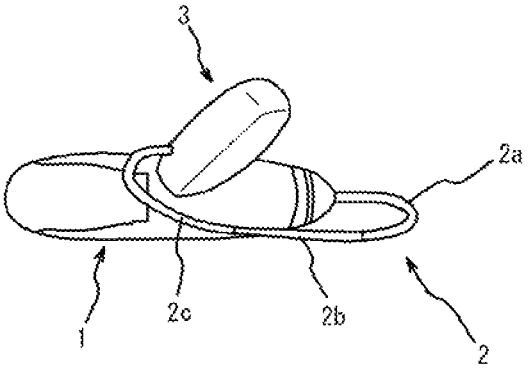

First, a first embodiment of the hearing device in which the present invention is embodied will be described with reference to FIGS. 1A to 1C and FIGS. 2A and 2B. The hearing device according to the present embodiment is configured as a cartilage conduction hearing aid which includes a hearing aid body 1, a cord 2, and an earphone (cartilage conduction earphone) 3 to shape a form referred to as so-called behind-the-ear type hearing aid, as shown in FIGS. 1A to 1C. Incidentally, the cartilage conduction hearing aid shown in FIGS. 1A to 1C is worn in an auricle 100 of a wearer's right ear shown in FIGS. 2A and 2B.

The hearing aid body 1 is provided with a housing having a gently curved form as a whole. A microphone which converts sound into an electrical signal, a hearing aid processing unit which processes the electrical signal outputted from the microphone to be fitted for hearing ability of the wearer, a battery supplying electric power to the respective portions constituting the cartilage conduction hearing aid or the like are assembled inside the housing.

The cord 2 connects the hearing aid body 1 and the cartilage conduction earphone 3 to each other. The cord 2 according to the present embodiment is constituted by a relatively thin electric wire through which an electric signal sent from the hearing aid body 1 is transmitted to the cartilage conduction earphone 3, and a coating material which is formed out of a flexible polymeric material (e.g. thermoplastic elastomer, nylon, or the like) to cover the outside of the electric wire so that the cord 2 can be bent into a shape shown in FIGS. 1A to 1C. The cord 2 according to the present embodiment is schematically formed with bending into a shape having a base end portion 2*a*, an intermediate portion 2*b* and a terminal end portion 2*c*. The base end portion 2*a* starts at the hearing aid body 1 and curves from the front toward the rear (see FIG. 1A), and the base end portion 2*a* extends toward the head of the wearer (see FIG. 1B). The intermediate portion 2*b* extends from the base end portion 2*a* toward the rear (see FIG. 1A). The terminal end portion 2*c* extends downward from the intermediate portion 2*b* while curving gently (see FIG. 1A), and the terminal end portion 2*c* extends toward the outside of the ear of the wearer (see FIG. 1B). A method for bending the cord 2 thus into the predetermined shape may be performed in the following manner by way of example. That is, a jig having a mold formed by engraving the illustrated shape is prepared in advance, and the cord 2 is fitted into the mold, and then heated and cooled. Incidentally, the cord 2 has restorability. When the shape of the cord 2 is changed from the illustrated state, elastic force is expressed to return the cord 2 to its original shape. In addition, the cord 2 is formed with bending into the shape of bilateral symmetry of the illustrated shape, in the case a hearing device worn in an auricle of the wearer's left ear.

As shown in FIGS. 1A to 1C, the cartilage conduction earphone 3 has a housing which is shaped like a rounded rectangular parallelepiped or an ellipsoid. An opening to which the cord 2 is connected is provided in a lower rear portion of the housing. The cord 2 is led into the housing through the opening. Incidentally, the opening is closed by a sealing agent. Moreover, an electromechanical transducer connected to the cord 2 is provided inside the housing. The electromechanical transducer vibrates based on the electric signal of the hearing aid body 1 transmitted through the cord 2. For example, a transducer called an electromagnetic type (a balanced armature type using restoring force of a spring), an electrodynamic type, or a piezoelectric type can be used as the electromechanical transducer. The electromechanical transducer according to the present embodiment is attached to vibrate in a direction designated by an arrow shown in FIG. 1B.

Figure 2A:
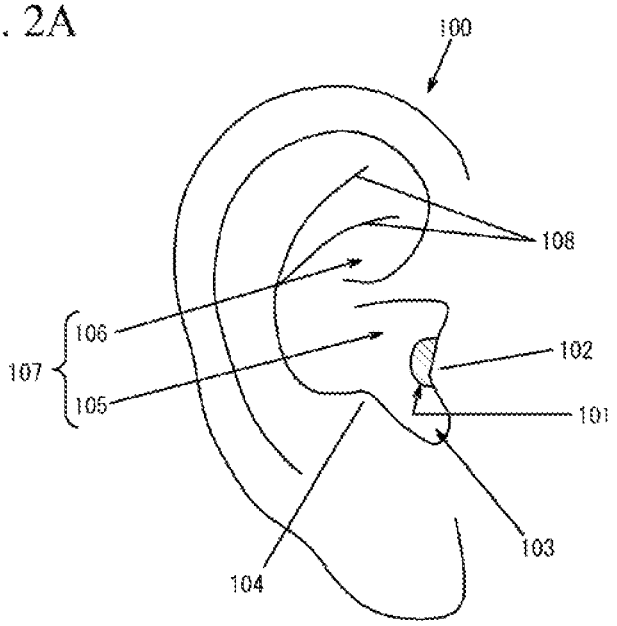
FIG. 2A is a view for explaining an auricle (of a right ear)
Figure 2B:
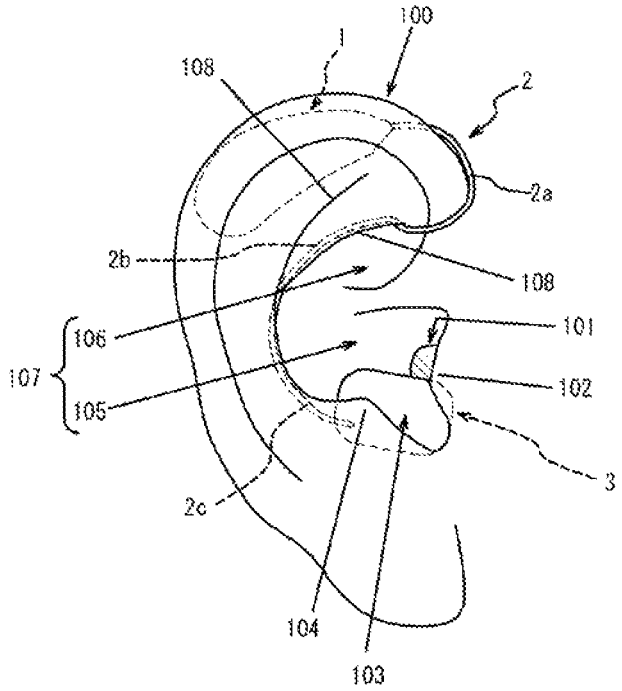
FIG. 2B is a view showing a state in which the cartilage conduction hearing aid shown in FIG. 1A to 1C is worn in the auricle.

The cartilage conduction hearing aid having such a configuration is worn in the auricle 100 shown in FIG. 2A, as shown in FIG. 2B. Specifically, the hearing aid body 1 is placed on an upper portion of the root of the ear from a back side of the auricle 100 while the base end portion 2*a* of the cord 2 is suspended from the upper from of the auricle 100. The cartilage conduction earphone 3 is inserted inside a tragus 102 and an antitragus 104. The cord 2 (mainly the intermediate portion 2*b*) is arranged to be hung on a cymba conchae 106 so that the cord 2 is made to abut against the cymba conchae 106 and extend along an antihelix crura 108. Thus, elastic force is generated from the cord 2 having restorability so that the cartilage conduction earphone 3 is pressed downward and frontward (toward a direction in which an intertragic notch 103 extends). Accordingly, the cartilage conduction earphone 3 is retained stably. Thus, vibration generated from the cartilage conduction earphone 3 can be conducted to a cartilage of the ear efficiently. Incidentally, the shape or size of the auricle 100 varies from one wearer to another. However, since the cord 2 can be deformed easily to some degree, the cord 2 can be used without any discomfort even if the shape or length of the cord 2 is not changed finely. Thus, the cord 2 is also excellent in terms of versatility. In addition, when the cartilage conduction earphone 3 is worn in the auricle 100, the cord 2 extends along the lower antihelix crura 108 while abutting against the cymba conchae 106. Further, the cord 2 extends along the inner side of the antitragus 104 to be connected to a lower rear portion of the housing of the cartilage conduction earphone 3 inconspicuously. Accordingly, the cord 2 is also excellent in terms of appearance. Incidentally, since the cord 2 is routed thus, the cord 2 is longer in length than that of the related-art cartilage conduction hearing aid. In addition, since the cord 2 makes contact with the cymba conchae 106, vibration of the cartilage conduction earphone 3 is hardly conducted to the hearing aid body 1. That is, since the vibration from the cartilage conduction earphone 3 is hardly fed back to the hearing aid body 1, howling can be suppressed. Further, even in a state in which the cartilage conduction earphone 3 is worn in the auricle 100, an external auditory canal 101 is open. Accordingly, the cartilage conduction earphone 3 can be used with comfortable feeling with openness.

Figure 3A:
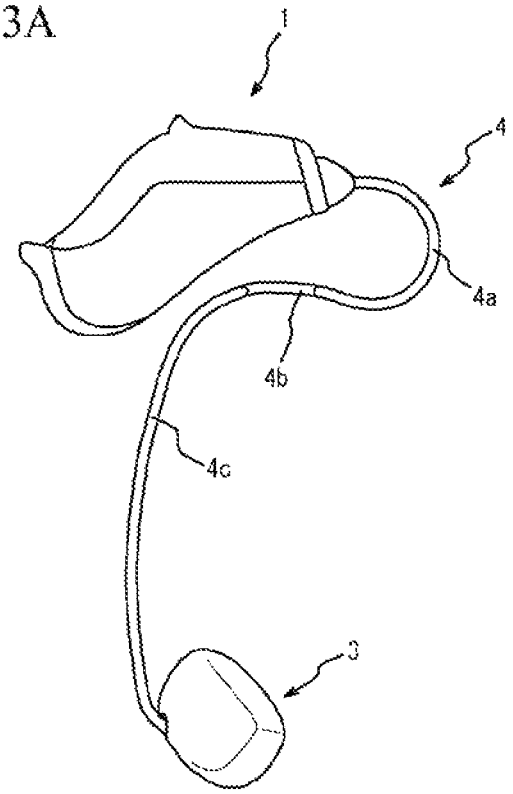
FIGS. 3A to 3C are views showing a modification of the first embodiment (for right ear use), FIG. 3A being a side view, FIG. 3B being a front view, FIG. 3C being a bottom view.
Figure 3B:
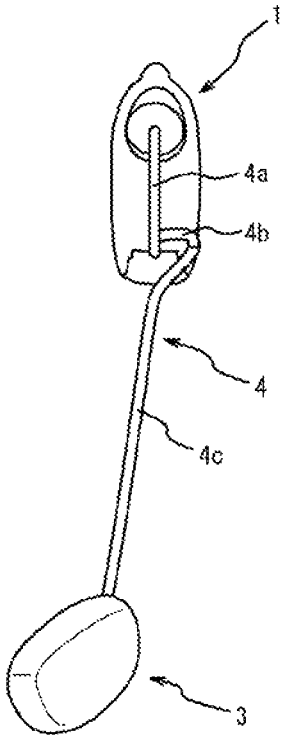
Figure 3C:
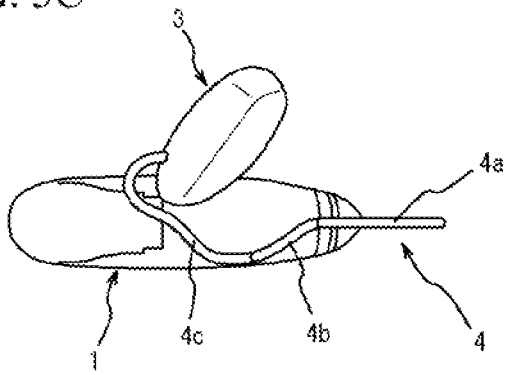

The shape of the cord 2 is not limited to the one shown in FIGS. 1A to 1C, but may be, for example, the shape of a cord 4 shown in FIGS. 3A to 3C. The cord 4 shown in FIGS. 3A to 3C is schematically beat into a shape having a base end portion 4*a*, an intermediate portion 4*b* and a terminal end portion 4*c*. The base end portion 4*a* starts at the hearing aid body 1 and curves from the front toward the rear (see FIG. 3A), and the base end portion 4*a* extends to be substantially unslanted to the head and the outside of the wearer (see FIG. 3B). The intermediate portion 4*b* extends rearward from the base end portion 4*a* (see FIG. 3A), and the intermediate portion 4*b* extends toward the head of the wearer (see FIG. 3B). The terminal end portion 4*c* extends downward from the intermediate portion 4*b* while curving gently (see FIG. 3A), and the terminal end portion 4*c* extends toward the outside of the ear of the wearer (see FIG. 3B). A cartilage conduction hearing aid using such a cord 4 can be also worn in the auricle 100 in a manner similar to or the same as the cartilage conduction hearing aid provided with the cord 2 shown in FIGS. 2A and 2B, and can obtain a similar effect or the same effect.

Figure 4A:
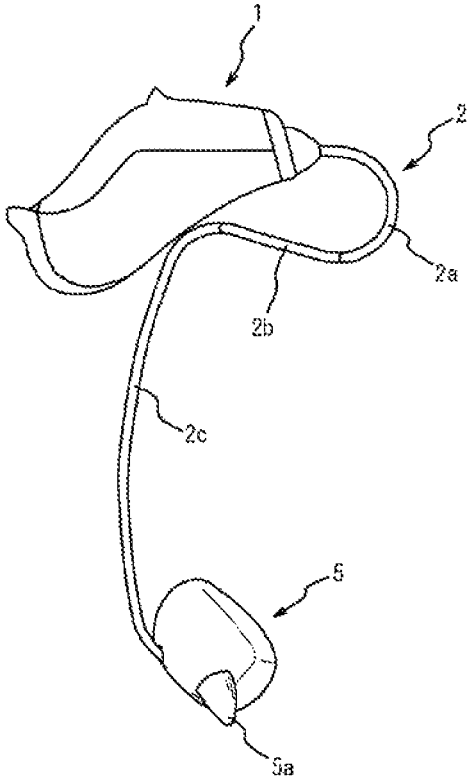
FIGS. 4A and 4B are views showing another modification of the first embodiment (for right ear use), FIG. 4A being a side view, FIG. 4B being a view showing a state in which the another modification of the first embodiment is worn in an auricle of an ear.
Figure 4B:
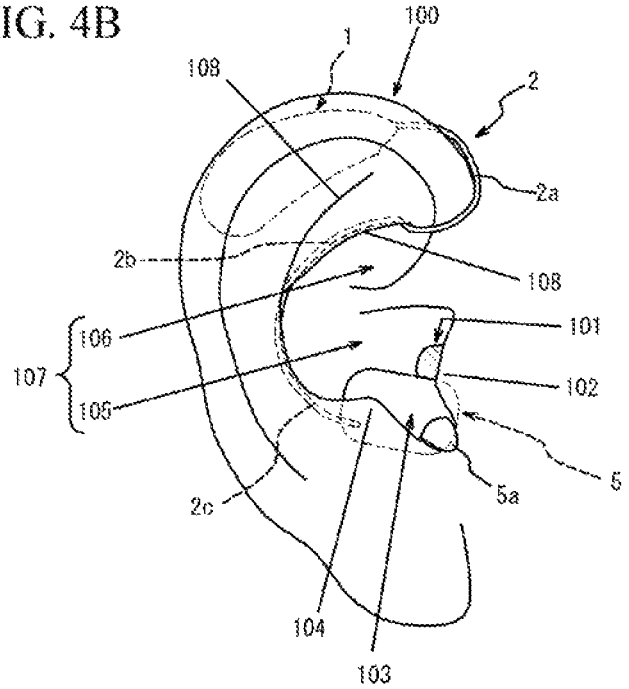

The shape or configuration of the cartilage conduction earphone 3 is also not limited to the one shown in FIGS. 1A to 1C. For example, a cartilage conductor earphone 5 shown in FIG. 4A includes a protrusion 5*a*, which is, for example, shaped like a cone and provided on a lower front portion of a housing. The housing is shaped like a rounded rectangular parallelepiped or an ellipsoid. When such a cartilage conduction earphone 5 is worn in the auricle 100, as shown in FIG. 4B, the protrusion 5*a* is received in the intertragic notch 103. Accordingly, the cartilage conduction earphone 5 can be worn in the auricle 100 more stably.

To increase retention stability of the cartilage conduction earphone 3 in the auricle 100 more greatly, the housing in the cartilage conduction earphone 3 may be formed into a shape in which the housing in the cartilage conduction earphone 3 can be received in a concha auriculae 107 (particularly in a cavum concha 105) tightly. In this case, a cover may be configured to be put on the housing, and the shape of the cover may be received in the concha auriculae 107 (particularly in the cavum concha 105) tightly.

Although not shown, an RIC type hearing aid including an earphone into which a receiver (speaker) is integrated in place of the cartilage conduction earphone 3 also uses the cord 2 shown in FIGS. 1A to 1C or the cord 4 shown in FIGS. 3A to 3C. Accordingly, the earphone can be stably retained in the auricle 100 or the external auditory canal 101. In addition, although not shown, a hearing device including an earphone into which an electromechanical transducer is integrated (the earphone vibrates to generate an air conduction sound) in place of the cartilage conduction earphone 3 also uses the cord 2 shown in FIGS. 1A to 1C or the cord 4 shown in FIGS. 3A to 3C. Accordingly, the earphone can be stably retained in the external auditory canal 101.

Next, a second embodiment of the hearing device in which the present invention is embodied will be described with reference to FIGS. 5A to 5F and FIGS. 6A and 6B. The hearing device according to the present embodiment is also configured as a cartilage conduction hearing aid which includes a hearing aid body 1, a cord 6, and an earphone (cartilage conduction earphone) 7, as shown in FIGS. 6A and 6B. Incidentally, after the cord 6 extends frontward from the hearing aid body 1 and further extends to approach the tragus 102, the cord 6 is connected to an upper face of the cartilage conduction earphone 7.

Figure 5A:
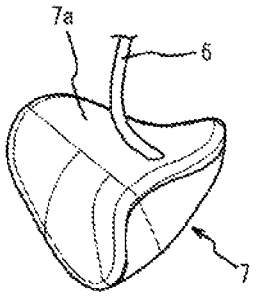
FIGS. 5A to 5F are views showing an earphone (cartilage conduction earphone) used in a second embodiment of the hearing device (cartilage conduction hearing aid) in which the present invention is embodied (for right ear use).
Figure 5C:
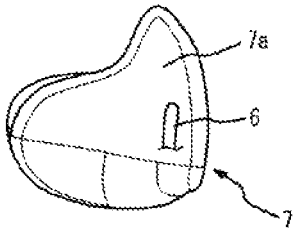
Figure 5E:
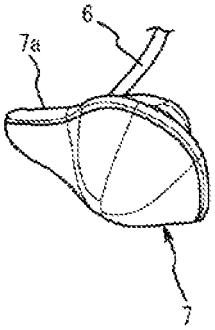
Figure 5B:
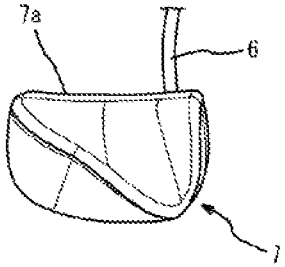
Figure 5F:
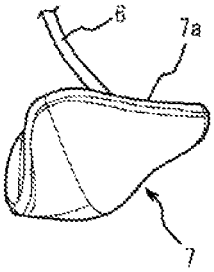
Figure 5D:
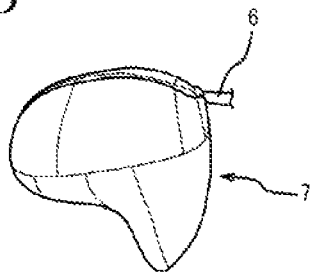
Figure 6A:
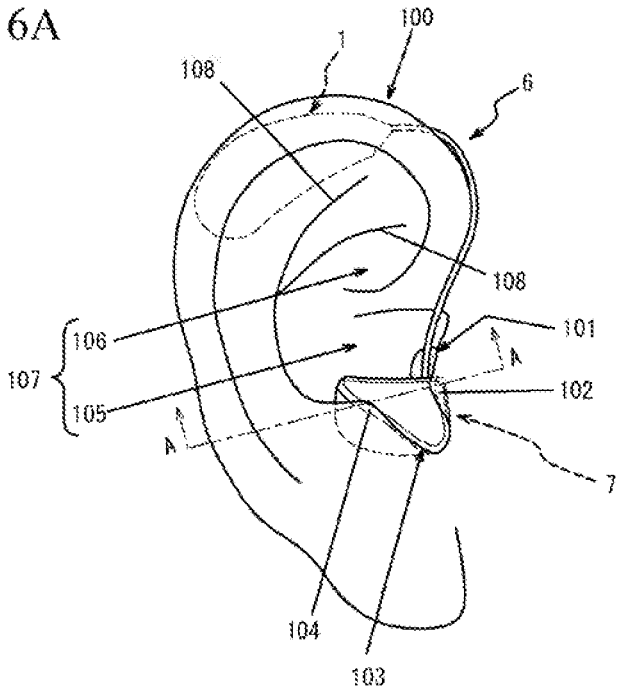
FIG. 6A is a view showing a state in which the cartilage conduction earphone shown in FIGS. 5A to 5F is worn in an auricle of an ear.
Figure 6B:
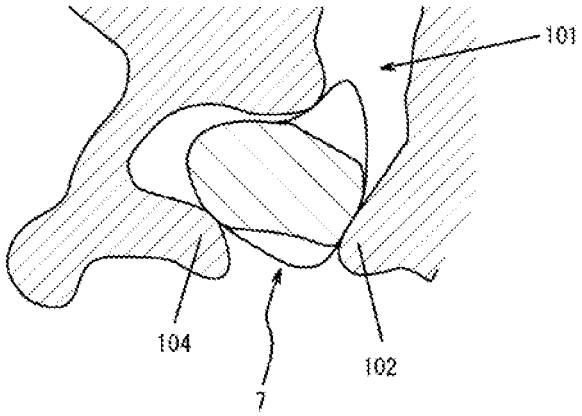
FIG. 6B is a sectional view taken alone a line A-A shown in FIG. 6A.

As shown in FIGS. 5A to 5F, the cartilage conduction earphone 7 includes the substantially flat upper face 7*a* extending in a horizontal direction. In addition, the shape of the cartilage conduction earphone 7 in plan view is formed into a triangle as a whole so that a side facing the outside of the ear of the wearer curves gently, while a side facing the inside of the ear of the wearer tapers off, as shown in FIG. 5C. In addition, the shape of the cartilage conduction earphone 7 in front view is formed into a triangle as a whole so that the side lacing the outside of the ear of the wearer extends substantially linearly in an up/down direction, while the side facing the inside of the ear of the wearer tapers off, as shown in FIG. 5F. A housing of the cartilage conduction earphone 7 is, for example, formed out of a polymeric material such as ABS or polycarbonate in the present embodiment. In addition, an electromechanical transducer connected to the cord is provided inside the housing of the cartilage conduction earphone 7 in a manner similar to or the same as the cartilage conduction earphone 3. The electromechanical transducer is similar to or the same as that of the cartilage conduction earphone 3, and description thereof will be therefore omitted.

In a state in which the cartilage conduction hearing aid having such a form is worn in an auricle 100 of an ear shown in FIG. 6A, the cartilage conduction earphone 7 abuts against at least two of an antitragus 104, a tragus 102, and an inlet of an external auditory canal 101 so as to be stably retained in the auricle 100. Therefore, vibration generated from the cartilage conduction earphone 7 can be efficiently conducted to a cartilage of the ear. The cartilage conduction earphone 7 according to the present embodiment abuts against three places in total, i.e. the antitragus 104, the tragus 102 and the inlet of the external auditory canal 101, as shown in FIGS. 6A and 6B. Accordingly, the cartilage conduction earphone 7 can be more stably retained when being worn in the auricle 100. Further, in the cartilage conduction earphone 7 according to the present embodiment, a region making contact with the auricle 100 is partial as described above, and an upper side of the external auditory canal 101 is open when the cartilage conduction earphone 7 is worn. Accordingly, comfortable feeling with openness can be obtained.

Figure 7A:
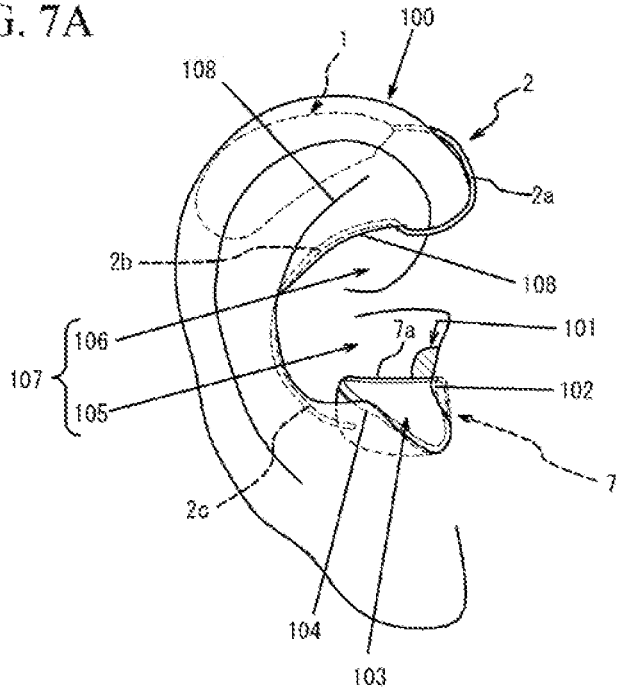
FIGS. 7A and 7B are views showing a modification of the second embodiment (for right ear use), FIG. 7A being a view showing a state in which a cartilage conduction hearing aid is worn in an auricle of an ear, FIG. 7B being a view showing a situation in which a cartilage condition earphone is pushed downward by a finger in order to wear the cartilage conduction earphone in the auricle.
Figure 7B:
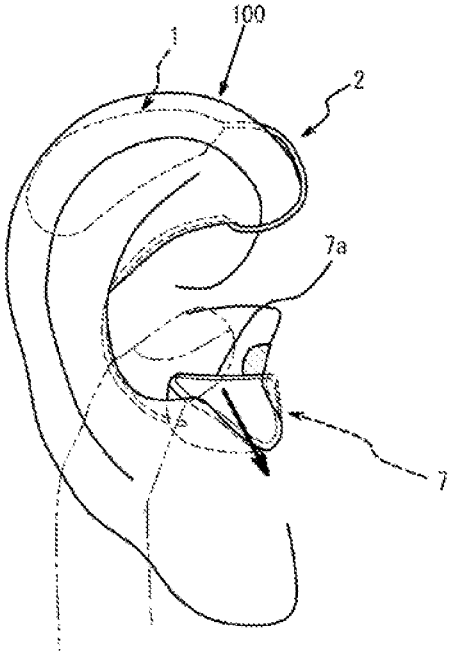
Figure 8A:
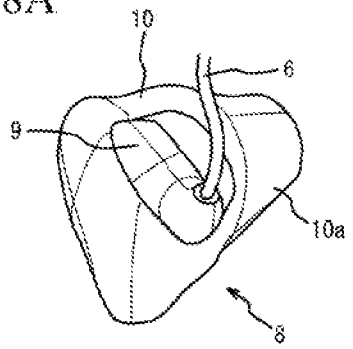
FIGS. 8A to 8F are views showing an earphone (cartilage conduction earphone) used in a third embodiment of the hearing device (cartilage condition hearing aid) in which the present invention is embodied (for right ear use), FIG. 8A being a perspective view, FIG. 8B being a side view, FIG. 8C being a plan view, FIG. 8D being a bottom view, FIG. 8E being a back view, FIG. 8F being a front view.
Figure 8C:
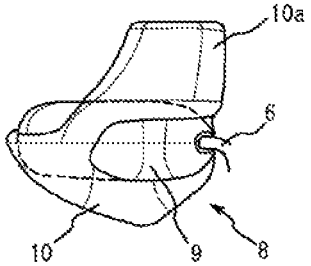
Figure 8E:
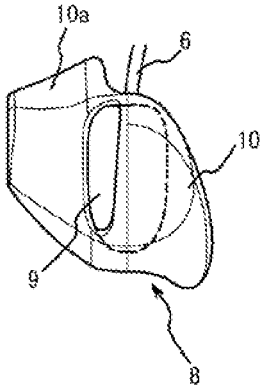
Figure 8B:
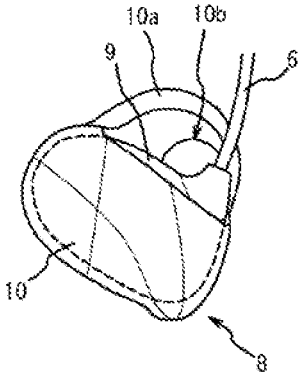
Figure 8F:
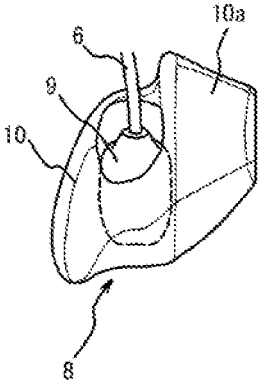
Figure 8D:
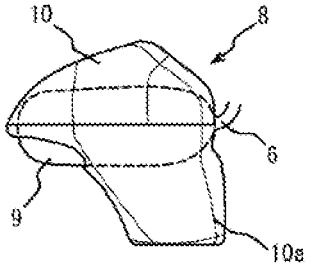

In a case where the aforementioned cord 2 is used as shown in FIGS. 7A and 7B in a cartilage conduction hearing aid using such a cartilage conduction earphone 7, elastic force is generated from the cord 2 made to abut against a cymba conchae 106. Accordingly, the cartilage conduction earphone 7 can be pressed downward and frontward. Consequently, the cartilage conduction earphone 7 can be retained in the auricle 100 more stably. Incidentally, in the cartilage conduction hearing aid shown in FIGS. 7A and 7B, the cord 2 is connected to a lower rear portion of the cartilage conduction earphone 7. In addition, the upper face 7*a* of the cartilage conduction earphone 7 is formed into a flat shape as described above. Therefore, the upper face 7*a* of the cartilage conduction earphone 7 can be easily pressed by a finger, as shown in FIG. 7B. That is, the cartilage conduction earphone 7 may be worn in a slightly floating state in the auricle 100. Even in such a case, the upper face 7*a* of the cartilage conduction earphone 7 can be pressed by the finger so that the cartilage conduction earphone 7 can be moved downward and frontward. Therefore, the floating can be canceled so that vibration generated by the cartilage conduction earphone 7 can be conducted to the cartilage of the ear as intended.

Figure 9A:
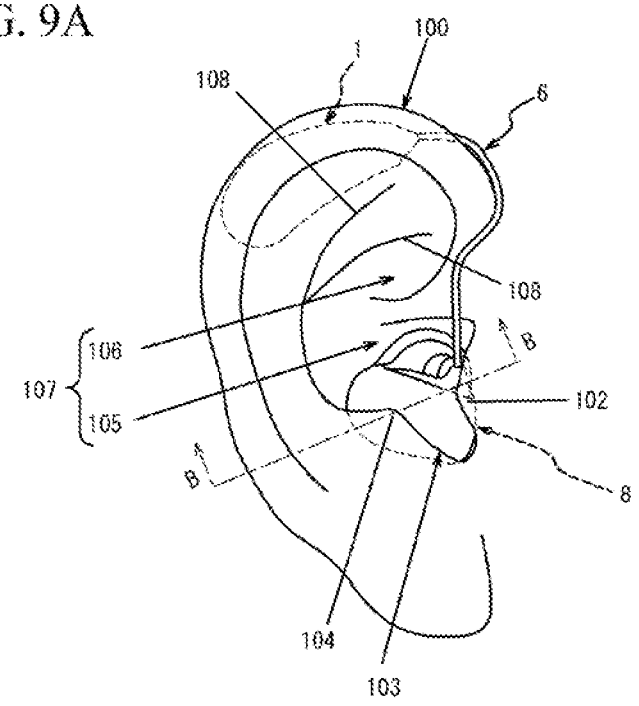
FIG. 9A is a view showing a state in which the cartilage conduction earphone shown in FIG. 8A to 8F is worn in an auricle of an ear.

Next, a third embodiment of the hearing device in which the present invention is embodied will be described with reference to FIGS. 8A to 8F and FIGS. 9A and 9B. The hearing device according to the present embodiment is also configured as a cartilage conduction hearing aid which includes a hearing aid body 1, a cord 6, and an earphone (cartilage conduction earphone) 8, as shown in FIGS. 9A and 9B.

As shown in FIGS. 8A to 8F, the cartilage conduction earphone 8 includes a body portion 9 and a cover 10. The body portion 9 has a housing shaped like a rounded rectangular parallelepiped or an ellipsoid. The cover 10 is put on the body portion 9. Incidentally, an electromechanical transducer connected to the cord 6 is provided inside the body portion 9. The electromechanical transducer is similar to or the same as that of the cartilage conduction earphone 3.

In the present embodiment, the cover 10 is formed out of an elastic and flexible material (e.g. silicone rubber, thermoplastic elastomer, or the like) and can be removably, put on the body portion 9. When the cover 10 according to the present embodiment is put on the body portion 9, a part of the body portion 9 is exposed. However, the body portion 9 may be entirely covered with and hidden by the cover 10. In addition, a cylindrical portion 10*a* extending toward the inside of the ear of a wearer is provided in the cover 10. As shown in FIGS. 9A and 9B, a vent 10*b* provided on a radially inner side of the cylindrical portion 10*a* so that the vent 10*b* communicates with an external auditory canal 101 when the cartilage conduction earphone 8 is worn. The vent 10*b* according to the present embodiment is shaped like a circle to have a relatively wide opening area.

Figure 9B:
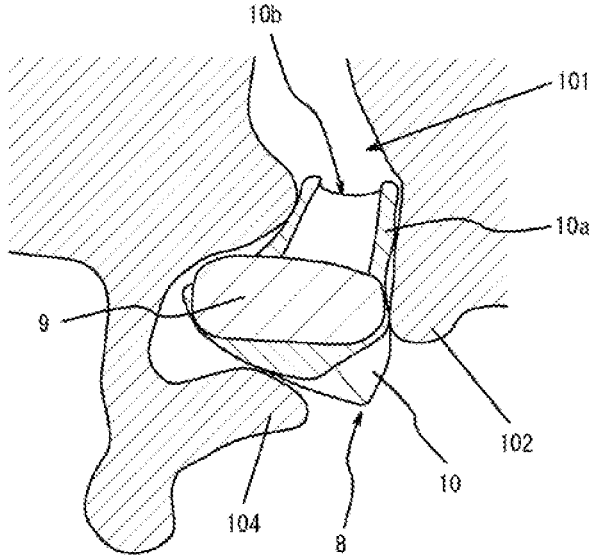
FIG. 9B is a sectional view taken along a line B-B shown in FIG. 9A.

In a state in which the cartilage conduction hearing aid having such a form is worn in an auricle 100, an outer circumferential face of the cylindrical portion 10*a* of the cover 10 abuts against an inlet of the external auditory canal 101 so that the cartilage conduction earphone 8 is stably retained in the auricle 100, as shown in FIG. 9B. The cover 10 according to the present embodiment also abuts against a tragus 102. Accordingly, the cover 10 is more stably retained in the auricle 100.

In addition, the vent 10*b* of the cover 10 communicates with the external auditory canal 101 when the cartilage conduction earphone 8 is worn. Accordingly, the external auditory canal 101 is not blocked so that comfortable feeling with openness can be obtained. Incidentally, sound pressure level (particularly sound pressure level in a low sound range) inside the external auditory canal 101 fluctuates due to an area of the external auditory canal 101 open toward the outside. Therefore, in a case where the vent 10*b* is not provided, there is a possibility that the area varies according to a wearing state of the cartilage conduction earphone in the auricle 100 so that the sound pressure level may fluctuate. On the other hand, in the present embodiment, since the vent 10*b* is provided, the opening area thereof does not vary due to the wearing state of the cartilage conduction earphone in the auricle 100. Accordingly, the sound pressure level (particularly the sound pressure level in the low sound range) inside the external auditory canal 101 can be made constant.

Figure 10A:
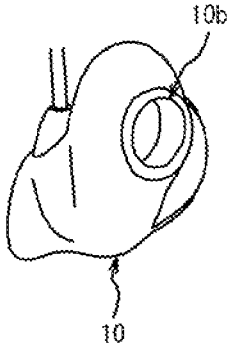
FIG. 10A is a perspective view from a direction in which a vent of the earphone shown in FIGS. 8A to 8F can be visually recognized.
Figure 10B:
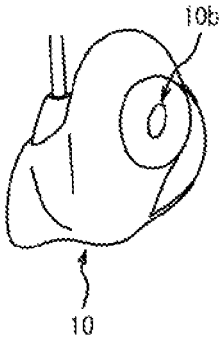
FIG. 10B to 10F are perspective views showing modifications of the earphone.
Figure 10C:
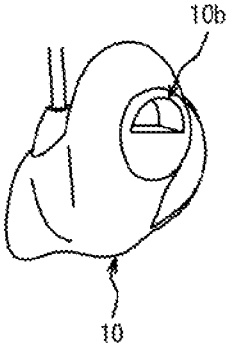
Figure 10D:
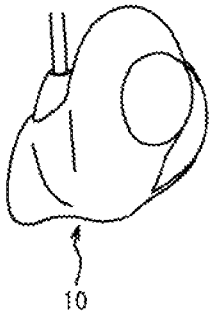

When the opening area of the vent 10*b* is reduced, sound leakage from the external auditory canal 101 is reduced. Accordingly, the sound pressure level (particularly the sound pressure level in the low sound range) inside the external auditory canal 101 can be increased. Therefore, in a case where the increase of the sound pressure level inside the external auditory canal 101 is prioritized over any other property, the opening area of the vent 10*b* may be reduced, as shown in FIG. 10B. In addition, the shape of the vent 10*b* can be changed variously. The vent 10*b* may be, for example, shaped like a semicircle, as shown in FIG. 10C. In addition, in a case where the increase of the sound pressure level inside the external auditory canal 101 is further prioritized, the vent 10*b* may be not provided, as shown in FIG. 10D.

Figure 10E:
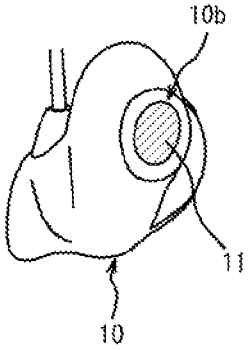
Figure 10F:
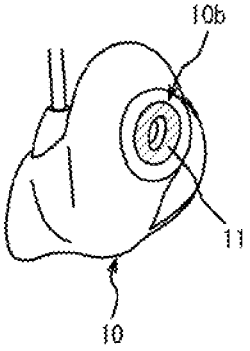

In a case where the sound pressure level (particularly the sound pressure level in the low sound range) inside the external auditory canal 101 has to be adjusted, a plurality of types of mounting members 11 which are different members from the cover 10 may be prepared in advance, as shown in FIGS. 10E and 10F so that a most suitable one of the mounting members 11 is mounted in the vent 10*b*. Incidentally, the mounting member 11 shown in FIG. 10E closes the vent 10*b*. The mounting member 11 shown in FIG. 11F narrows the opening area of the vent 10*b*.

In the hearing device in which the cord connecting the hearing aid body and the earphone to each other abuts against the cymba conchae of the ear when the earphone is worn, elastic force acts on the earphone from the cord supported by the cymba conchae. Accordingly, the earphone worn in the auricle or the external auditory canal can be stably retained. Further, since the cord abuts against the cymba conchae, the cord hardly stands out. Therefore, the hearing device is also excellent in terms of appearance.

In addition, in the earphone which can conduct vibration based on an electric signal to the cartilage of the ear, and which abuts against at least two of the antitragus, the tragus and the inlet of the external auditory canal of the ear when the earphone is worn, the earphone can be stably retained even if a region of the earphone making contact with the auricle is reduced. Accordingly, the vibration generated thus can be efficiently conducted to the cartilage of the ear. Further, since the region making contact with the auricle can be reduced, comfortable wearing feeling can be obtained.

The earphone which can conduct vibration based on an electric signal to the cartilage of the ear, and in which the vent communicating with the external auditory canal is provided in the cover put on the body portion can be stably retained in the auricle by the cover. Moreover, the earphone does not block the external auditory canal but provides a feeling of openness. Thus, comfortable feeling with openness can be obtained.

The embodiments of the present invention have been described above. However, the present invention is not limited to such specific embodiments. Various modifications or changes can be made within the scope of the gist of the present invention stated in CLAIMS unless otherwise limited specially in the aforementioned description. For example, a configuration provided by one of the aforementioned embodiments may be applied to another embodiment. In addition, the cord 2, 4, 6, the cartilage conduction earphone 3, 5, 7, 8, the cover 10, etc. are formed into the illustrate shapes laterally symmetrically to those of the hearing device worn in the auricle of the wearer's left ear. In addition, the effects of the aforementioned embodiments are merely exemplified effects caused by the present invention, which does not mean that the effects caused by the present invention are limited to the aforementioned effects. In addition, the hearing device is not limited to a hearing instrument such like a hearing aid but can be also applied to an audio device such like an audio earphone.

What is claimed is:

1. A hearing device comprising:

an earphone that is adapted to be worn in a concha auriculae or an external auditory canal of an ear; and a cord that is adapted to extend so as to pass through an upper portion of a root of the ear from a back side of an auricle of the ear when the earphone is worn, and that is connected to the earphone, the cord that is adapted to abut against a cymba conchae of the ear when the earphone is worn, wherein the earphone includes a protrusion that is adapted to be received in an intertragic notch of the ear, wherein, when the earphone is worn, the protrusion is adapted to extend from an inner side of the ear, in which the earphone is worn, to an outer side of the ear via the intertragic notch.

2. The hearing device according to claim 1, wherein the cord is adapted to extend along an antitragus of the ear from the cymba conchae when the earphone is worn.

3. The hearing device according to claim 1, wherein the earphone is a cartilage conduction earphone that is configured to conduct vibration based on an electric signal to a cartilage of the ear.

4. An earphone that is configured to conduct vibration based on an electric signal to a cartilage of an ear, the earphone accommodated in a housing which is adapted to abut against at least two of an antitragus, a tragus and an inlet of an external auditory canal of the ear, and by which an outer surface of the housing does not overlap with a portion of the inlet of the external auditory canal at an upper side of the external auditory canal such that outer surface of the housing is spaced apart from the upper side of the external auditory canal and the portion of the inlet is made open, when the earphone is worn.

5. A hearing device comprising:

the earphone according to claim 4.

6. An earphone comprising:

a body portion that is configured to conduct vibration based on an electric signal to a cartilage of an ear, and that is internally provided with an electromechanical transducer, the body portion having a housing having a first shape; and a cover that is removably put on the housing of the body portion and having a second, nonsymmetrical shape different from the first shape, the cover is adapted to abut against an inlet of an external auditory canal of the ear, and that includes a vent to open between the external auditory canal and an external environment, when the earphone is worn, wherein the cover is adapted to abut against a tragus when the earphone is worn and comprises a cylindrical portion adapted to extend into and abut the inlet of the external auditory canal, and the vent is provided on a radially inner side of the cylindrical portion such that the vent communications with the external auditory canal when the earphone is worn.

7. The earphone according to claim 6, further comprising:

a mounting member that is mounted in the vent so as to change an opening area of the vent.

8. A hearing device comprising:

the earphone according to claim 6.

9. The earphone according to claim 6, wherein the first shape is one of a rounded rectangular parallelepiped and an ellipsoid shape, and the cylindrical portion is offset from a center of the first shape in a direction perpendicular relative to the external auditory canal.

* * * * *